United States Patent [19]

Green et al.

[11] 4,016,985

[45] Apr. 12, 1977

[54] COMBINATION BULK TOBACCO RACK LOADER AND UNLOADER AND METHOD OF UNLOADING A BULK TOBACCO RACK

[76] Inventors: John Charles Green, Rte. 1, Box 114, Lillington, N.C. 27546; Ronald Edward Wheeler, Rte. 2, Angier, N.C. 27501

[22] Filed: Feb. 14, 1975

[21] Appl. No.: 550,122

[52] U.S. Cl. ..... 214/5.5; 56/27.5; 294/5.5

[51] Int. Cl.[2] ..... A24B 1/06

[58] Field of Search ..... 214/5.5; 294/5.5; 56/27.5; 296/5

[56] References Cited

UNITED STATES PATENTS

| | | | |
|---|---|---|---|
| 3,107,792 | 10/1963 | Mish | 214/5.5 |
| 3,197,042 | 7/1965 | Harrington | 214;294/5.5 |
| 3,211,300 | 10/1965 | Woolard | 214/5.5 |
| 3,229,831 | 1/1966 | Long | 214;294/5.5 |
| 3,776,392 | 12/1973 | Williams | 214/5.5 |
| 3,807,782 | 4/1974 | Taylor | 214/5.5 |

*Primary Examiner*—Joseph F. Peters, Jr.
*Assistant Examiner*—John A. Carroll
*Attorney, Agent, or Firm*—Mills and Coats

[57] ABSTRACT

A combination bulk tobacco rack loader and unloader, and method of unloading a bulk tobacco rack is disclosed. The combination bulk tobacco rack loader and unloader comprises a generally open frame structure adapted in the unloading mode to receive filled bulk tobacco rack on its side with the plane of the tobacco leaves therein being generally horizontally disposed in overlying relationship, the bulk tobacco rack being of the type having first and second sections latched together and with tines fixed to at least one section and extending therefrom to penetrate and support the bulk volume of tobacco leaves peripherally contained therein. Once placed in the apparatus or device of the present invention, the same is adapted upon selective actuation to unlatch at least one latching mechanism associated with the bulk rack to allow one section of the rack to be pulled from the other section.

22 Claims, 9 Drawing Figures

FIG. 2
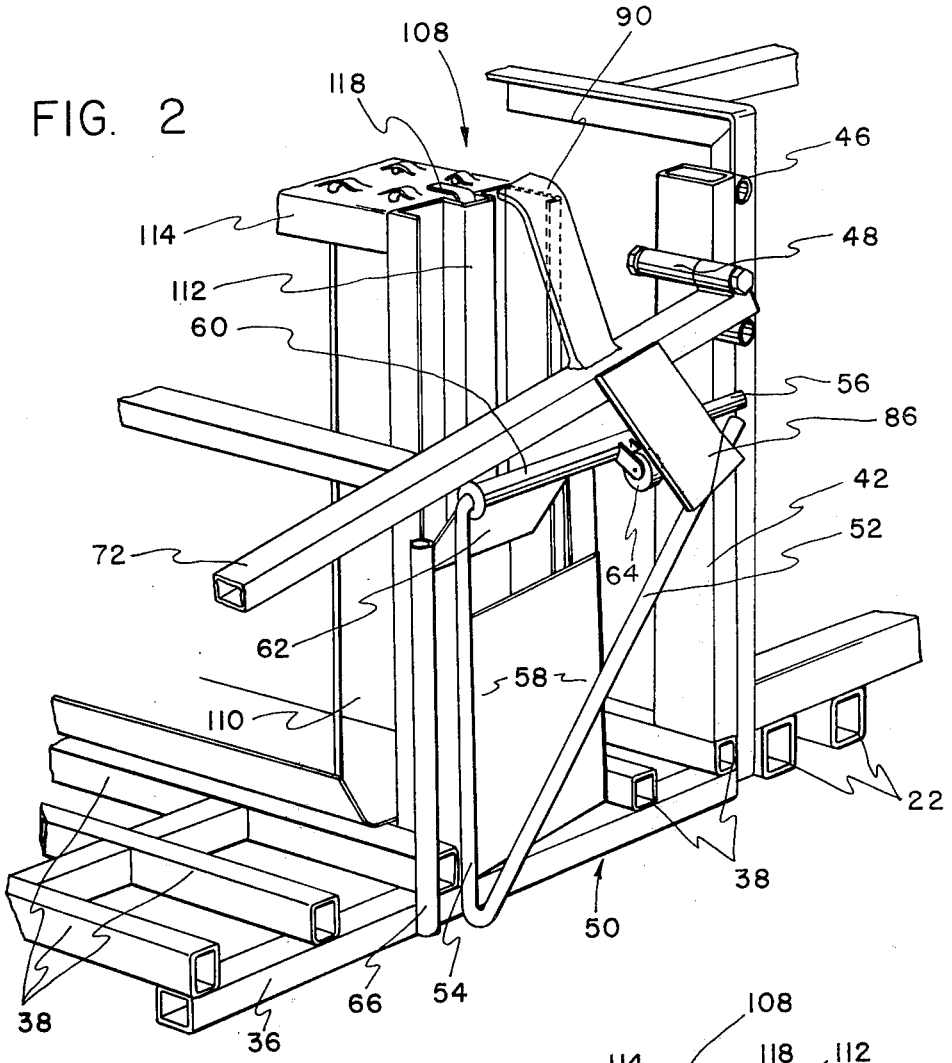
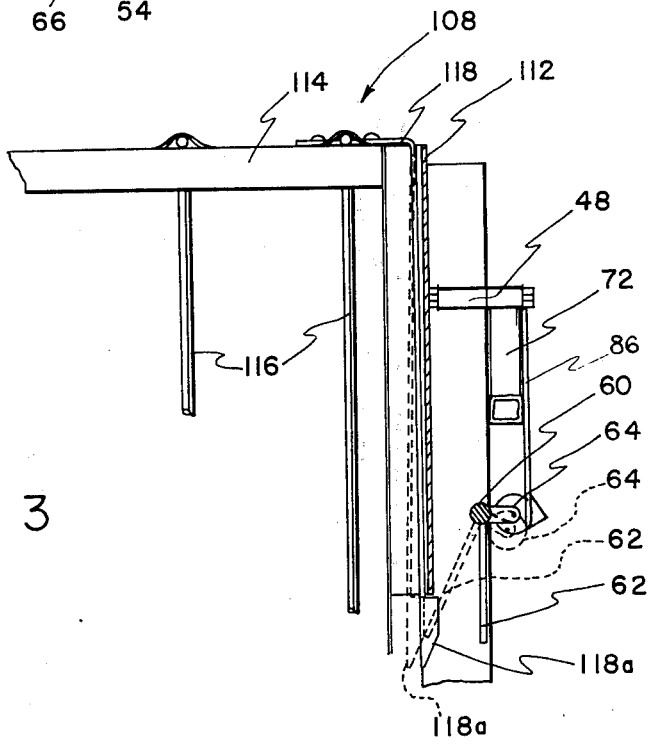
FIG. 3

COMBINATION BULK TOBACCO RACK LOADER AND UNLOADER AND METHOD OF UNLOADING A BULK TOBACCO RACK

The present invention relates to bulk tobacco handling, and more particularly to a device for loading and unloading bulk tobacco racks of the type having two rack sections that are adapted to be connected by a latching mechanism and wherein at least one rack section includes a plurality of tines fixed thereto and extending therefrom.

BACKGROUND OF THE INVENTION

Today tobacco farmers are turning to bulk curing at an increasing rate because in very simple terms bulk curing of tobacco is more efficient and perhaps even more important bulk curing of tobacco entails a system of handling tobacco that substantially reduces labor requirements as compared to the old "stick barn" method. While bulk curing was a very significant step in tobacco mechanization, there has been little, if any, progress in improving the method of loading and unloading conventional single tier bulk tobacco racks used in bulk tobacco curing systems.

The conventional single tier bulk tobacco rack comprises two sections adapted to be latched together with one rack section having a plurality of tines fixed to and projecting therefrom to penetrate a bulk volume of tobacco peripherally contained by the rack when latched together. Such bulk racks normally include a latching mechanism disposed on each end thereof, the latching mechanism operative to latch and hold the two rack sections together so as to support a bulk volume of tobacco therebetween.

Normally in loading a bulk rack, the tine section is separated from the other section which typically is an open generally U-shaped section. Green tobacco is placed within the open U-shaped section normally supported in an upright position by a horizontal surface. After a certain volume of tobacco is placed in the U-shaped section of the rack, the tine section is properly aligned with the U-shaped section and pressed downwardly into a latched relationship therewith. Because the tines must penetrate through the volume of tobacco, a substantial force is required to press the tine section into a latch relationship with the U-shaped section of the rack. Often in practice, it requires two individuals, one pushing down on each side of the tine section, to press the tine section of the rack through the bulk volume of tobacco and into a firm latched relationship with the bottom generally U-shaped section. It is often difficult to press the tine section downwardly far enough to achieve latching and after repeated unsuccessful attempts, this hand-pressing task tends to become very aggravating — not to mention the effort and labor required in loading a large number of racks during a day.

Once the tobacco has been placed in the barns and cured and dried, the racks, of course, must be removed from the barn and unloaded with the tobacco being removed from the rack and placed in sheets or the like where the tobacco may be stored or transported to market. Like the rack loading operation described above, the unloading of the racks also requires substantial time, effort and labor. In particularly, each rack must be removed from the barn and to efficiently empty the barn the normal practice requires that at least two individuals be utilized to unlatch the racks and remove the tine section therefrom. In unloading the racks, a typical practice is for one individual to be stationed at each end of the rack and to unlatch the latching mechanism disposed at that respective end of the rack. Once unlatched, the two individuals can remove the tine section of the rack and as that section is being removed, it is necessary for each of the individuals to strip tobacco from the tines of the section being removed. In this stripping operation, the individual generally pulls and holds the rack with one hand while using the other hand to strip and push the tobacco stripped back down into the pile of tobacco generally held within the confines of the open generally U-shaped rack section. After the tobacco has been stripped from the tines and the tine section removed, the tobacco disposed in the open U-shaped rack may be removed therefrom and placed into sheets or the like for storage or transport to market.

It should also be pointed out that the total time required to empty a barn is often quite critical in a tobacco farming operation. This is because of two principal reasons. First, it is quite common for the farmer to empty the same barn or barns the same day that he plans to fill such barn or barns. This is because the farmer usually invests in only the minimum number of barns required to accommodate a given size crop, and during the peak harvesting season, he usually plans to harvest at a rate that will keep all of the barns filled all the time. Consequently, if the farmer is to unload a barn that is to be filled the same day, it follows that this must be done quickly and efficiently so that the harvesting operation can begin and the barn refilled. The second reason that time is very critical in unloading the racks and emptying a bulk tobacco barn is that the tobacco is in better "order" to handle in the early morning hours of the day. As the day grows longer, the tobacco tends to become drier, crispy and very difficult to handle without breaking and crumbling the tobacco leaves. Thus, it is quite important to unload the barn during the early morning hours when the tobacco leaf material is relatively soft due to the increased moisture content of the leaf during this part of the day.

SUMMARY OF THE PRESENT INVENTION

The present invention has been devised to be used in conjunction with a conventional single tier bulk tobacco rack to assist in loading and unloading the same. The device or apparatus of the present invention is particularly designed to increase the efficiency of both loading and unloading a conventional bulk tobacco rack, and as such, the device of the present invention is so designed that as few as one individual may utilize the same to both load and unload conventional single tier bulk tobacco racks.

In particularly, the device of the present invention comprises a generally open frame structure that is adapted to receive a conventional bulk tobacco rack or a portion thereof. In the loading mode, the device of the present invention is adapted to receive the open generally U-shaped rack section of a conventional bulk rack and adapted to support that section while leaves of tobacco are placed across the plane of the rack and within the general confines thereof. After a certain quantity of tobacco is placed about the open generally U-shaped rack section, the apparatus or device of a present invention includes a press structure pivotably mounted about a transverse axis on the device, and adapted to engage and push a tine section of a bulk rack into a latched relationship with the open generally U-shaped rack section. The press structure is designed to be hand actuated and extends substantially the entire length of the rack and is adapted to engage the top of the tine section and under the influence of external force applied to the press structure with an operator's hand, the tine section is pressed downwardly and as the same is pressed downwardly, the tines carried thereby engage and penetrate through the bulk volume of tobacco disposed between the respective two rack sections. Once the tine section of the rack is latched with the open generally U-shaped section, the entire rack can then by means of a chain hoist or the like be lifted from the apparatus of the present invention and placed directly in the barn.

In the unloading mode, the rack receiving device or combination rack loader and unloader, receives the rack such that the rack extends generally between two unlatching mechanisms disposed on opposite sides of the device or combination loader and unloader. To begin the unloading operation, a tobacco retaining frame is moved downwardly to where the same lies transversely across the top portion of the bulk tobacco volume held within the rack. Due to the position occupied by the rack, the tine section is normally disposed above the open U-shaped section and the retaining frame is designed so as to allow the tine section to be pulled therepassed without interference. Once the retaining frame has been lowered into engagement with the top portion of the tobacco, the same actuates the unlatching mechanisms disposed on opposite sides of the combination loader and unloader, resulting in the respective latching mechanisms of the rack being unlatched. After unlatching the rack on both ends, the tine section can thusly be pulled from the combination loader and unloader and as the same is being pulled therefrom, the retaining frame engages the bulk volume of tobacco and maintains the same generally below the plane or level of the retaining frame. This, of course, has the effect of stripping the tobacco from the tines of the rack section removed. Once the tine carrying rack section has been removed, the retaining frame can be pivoted back to its inoperative position thereby allowing the tobacco to be removed from the generally U-shaped rack section.

It is, therefore, an object of the present invention to provide a device for mechanically assisting in the loading and/or unloading of a conventional single tier bulk tobacco rack.

A further object of the present invention is to provide a combination bulk rack loader and unloader that is adapted to assist in both the loading and unloading of a bulk tobacco rack.

A further object of the present invention resides in the provision of a bulk tobacco rack unloader apparatus that will: (1) mechanically unlatch at least one latching mechanism associated with a conventional bulk tobacco rack, and (2) retain the tobacco within the general confines of one stationary rack section while another rack section is removed from the apparatus.

A further object of the present invention is to provide a combination bulk tobacco rack loader and/or unloader specifically adapted to accommodate and work in conjunction with a conventional separable double section bulk tobacco racks in loading and/or unloading such racks.

A more particular object of the present invention is to provide a press for pressing the tine section of a conventional bulk tobacco rack into a latched relationship with an open generally U-shaped rack section, wherein during the pressing operation, the tines are forced through a bulk volume of tobacco and the tine section is guided into proper alignment with the open generally U-shaped section.

Still a further object of the present invention resides in the provision of an apparatus for mechanically breaking-down a double section bulk tobacco rack wherein the apparatus is provided with hand actuated means for unlatching the normally latched double rack sections and retaining the tobacco therein below a certain plane or level while one rack section, typically a section having tines associated therewith, is removed from the apparatus.

A more specific object of the present invention resides in the provision of an apparatus for breaking-down and assisting in the unloading of a conventional bulk tobacco rack of the type comprising double sections latched together, wherein there is provided movable retaining means operative to assume a position above the tobacco held within the bulk rack and to actuate the unlatching mechanism associated with the apparatus in response to being moved into the operative retaining position, whereby once moved into an operative retaining position above the tobacco held within the rack, one rack section may be removed while the other section is held within the unloader apparatus and wherein the retaining frame retains and holds the tobacco below the level thereof while the one rack section is removed.

Another object of the present invention is to provide a combination bulk tobacco rack loader and/or unloader that is relatively simple in construction, easy to operate and which enables as few as one individual to load and/or unload a conventional bulk tobacco rack without having to exert a great amount of effort and labor.

Other objects and advantages of the present invention will become apparent from a study of the following description and the accompanying drawings which are merely illustrative of the present invention.

BRIEF DESCRIPTION OF THE DRAWINGS

FIG. 2 is an enlarged fragmentary perspective view of a portion of the combination rack and unloader unit illustrating the unlatching mechanism.

FIG. 3 is a perspective view of a portion of the unlatching mechanism associated with the combination bulk tobacco rack and unloader of the present invention, the view particularly illustrating the engagement of a cam plate with the latching member of the bulk tobacco rack held within the loader and unloader apparatus.

DESCRIPTION OF THE PREFERRED EMBODIMENT

Figure 1:
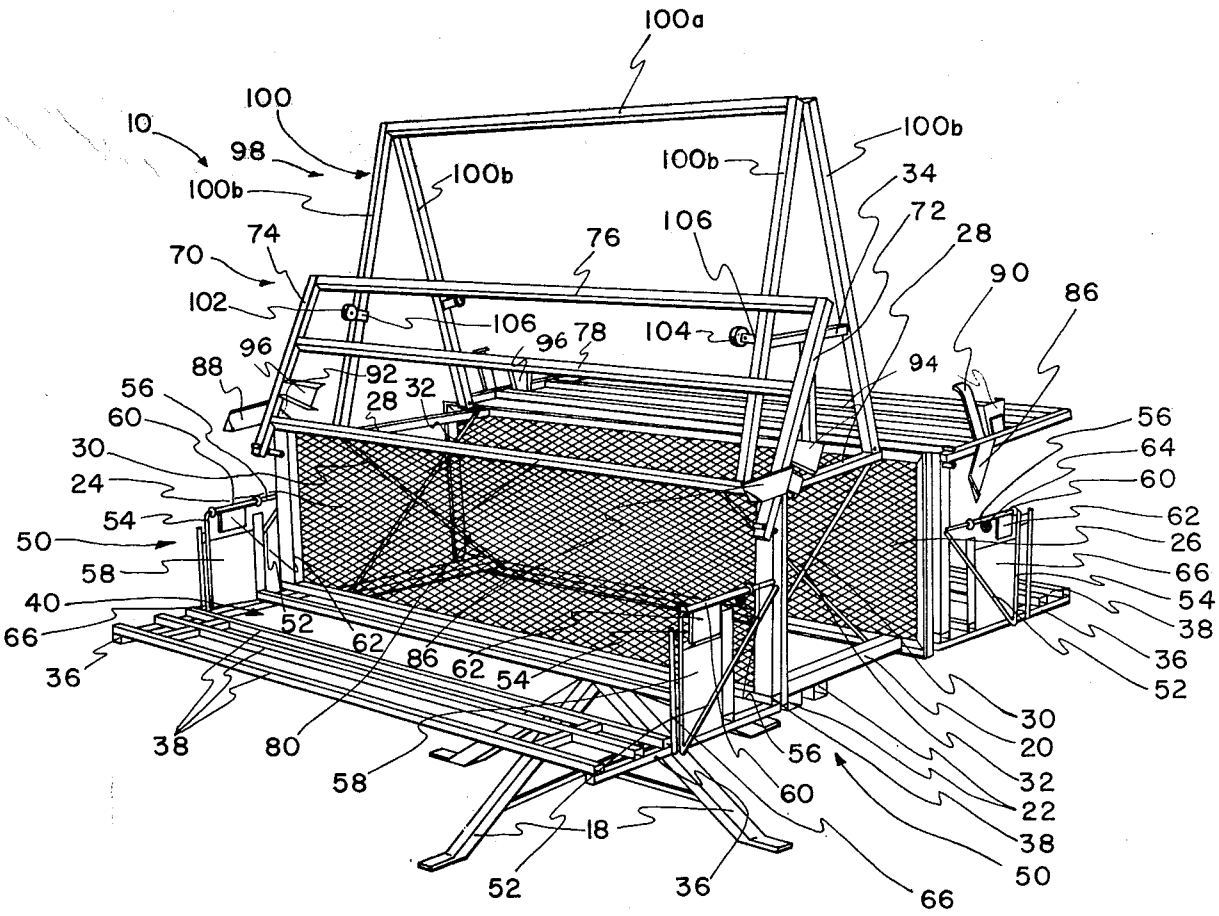
FIG. 1 is a perspective view of the combination bulk tobacco rack loader and unloader of the present invention, the view illustrating two like units disposed in back-to-back relationship and mounted on a turn table.

With further reference to the drawings, particularly FIG. 1, the combination bulk tobacco rack loader and unloader of the present invention is shown therein and indicated generally by the numeral 10. The combination rack loader and unloader, as shown herein, includes two separate units mounted on a turn table assembly indicated generally by the numeral 12. First, viewing the turn table 12 in detail, it is seen that the same basically includes a rotor 14 (FIGS. 4–8) rotatively mounted in an upright rotor column 16 supported by a plurality of legs 18 depending therefrom. Fixed to the rotor 14 is a plurality of relatively closed spaced cross members 22 with the cross members 22 having fixed thereto and extending thereacross a plurality of spaced apart horizontal main support members 20. It is, therefore, appreciated that the cross members 22 and horizontal members 20 form a generally open horizontal frame that is rotatable about the axis of the rotor column 16.

Continuing to refer to the turn table 12, a pair of back screens 24 and 26 are fixedly mounted transversely across the outside horizontal members 20, and the screens are retained in generally vertical planes by a pair of horizontal cross members 28 that extend between the inner sides of the screens about an outer and upper position relative thereto. In addition, about each side of the turn table 12, there is provided a cross brace assembly between the respective screens, the cross brace assembly on each side including two cross braces 30 and 32 having their ends fixed to the screen and surrounding frame structure. Finally, fixed to each cross bar 28 generally about the mid-point thereof and extending upwardly therefrom is a T-bar 34.

Disposed on each end of the turn table 12 is a rack loader and unloader unit, each unit being pivotably mounted to respective horizontal members 20 about a transverse axis that extends generally parallel to the axis of the cross members 22. More particularly, each rack loader and unloader unit generally rests on respective horizontal members 20 and the axis of pivotable movement is generally spaced outwardly towards the end of the turn table in order that the rear portion of each unit may pivot upwardly relative to the platform towards an individual standing outwardly of the end of the platform during the rack unloading operation. The significance of this pivotable movement will become clear in a subsequent portion of this disclosure dealing with the specifics of the unloading operation. For the purposes of discussion, only one of the rack loader and unloader units will be described in detail since both units disposed on the turn table 12 are essentially identical in structure and function. At the outset the description of each loader and unloader unit will be focused on the structure, and the function of each loader and unloader unit will be subsequently discussed herein.

Each combination bulk tobacco rack loader and unloader unit comprises a generally horizontal bottom that is of an open frame construction and includes, as illustrated in the drawings, a pair of laterally spaced end runners 36 interconnected by a plurality of spaced apart cross members 38 extending transversely across the platform of the turn table 12. The cross members 38 are particularly spaced so as to define a transverse rack seat indicated generally by the numeral 40 in the lower bottom portion thereof. As will become apparent from subsequent disclosure herein, a conventional double sectional bulk tobacco rack can be received and supported by each unit about the rack seat 40.

Extending upwardly from the rear corners of the bottom frame just described, is a pair of vertical back posts 42 and 44, each back post including upper and lower pivot sleeves 46 and 48, respectively.

In addition, along each side of the rack loader and unloader unit is a side frame assembly that is disposed just forwardly of the vertical back posts 42 and 44. Viewing this side frame assembly in greater detail, it is seen that the same comprises a diagonal member 52 extending between a respective back posts 42 or 44 downwardly to a respective end runner 36. Extending upwardly from the diagonal member 52 is a vertical member 54 that has fixed to its upper end a horizontal member 56 that extends therefrom rearwardly towards a respective back post (42 or 44) where the horizontal member joins the same. Fixed to the vertical member 54 is a guide plate 58 that generally projects rearwardly and inwardly along the bottom frame of each rack loader and unloader unit to where the rearmost edge is fastened to an upstanding member extending upwardly from the bottom frame. The two guide plates 58 cooperate with each other to guide the rack into the proper position when being placed into operative relationship with the rack loader and unloader unit.

Rotatively mounted on each horizontal member 56 is a rock shaft 60, each rock shaft having an unlatching plate 62 fixed thereto and extending downwardly therefrom where the unlatching plate assumes a first inoperative position. Also, fixed to the rock shaft 60 is a cam follower 64 which is rotatively mounted on an arm extending from the rock shaft.

Fixed to the bottom frame of each unit just forwardly of the side frame assembly 50 is an upstanding rod 66 that is adapted during the loading operation to receive a retaining rod 68 that is particularly curved and shaped so as to extend upwardly along side of the volume of tobacco being placed in a rack. The precise function of this retaining rod 68 will be better understood and appreciated after a discussion of the rack loading operation.

Pivotably mounted to the upper end of each vertical back posts 42 and 44 is a retaining frame indicated generally by the numeral 70, the retaining frame also being referred to as a rack guide frame since it does support guides that function to guide one section of the rack downwardly into the tobacco during the loading operation. Discussing the structure of the retaining frame 70 in detail, it is seen that the same comprises two end members 72 and 74 joined by a series of cross members 76, 78 and 80. (The lowermost cross member, as viewed in FIG. 1, may be designed to be detachably mounted between the end members 72 and 74 so that it may be removed during the loading operation to avoid possible interference with the tobacco being loaded.) Two sets of pivot sleeves are secured about each side of the retaining frame 70 and are adapted to cooperate and align with either the upper or lower pivot sleeves 46 and 48 mounted on the upper portion of the back posts 42 and 44. This allows the retaining frame 70 to be mounted about at least two axes and, therefore, it is seen that the position of the retaining frame 70 may be adjusted with respect to the position normally occupied by a rack when disposed within the bulk loader and unloader unit.

Fixed to each end members 72 and 74 and extending therefrom is a pair of cam arms 86 and 88 that are operative during the unloading operation to engage the cam follower 64 when the retaining frame 70 is pivoted downwardly to a rack unlatching position (FIG. 2). Also, each end member 72 and 74 includes a rack retainer 90 and 92 that is so disposed when the retaining frame 70 is in the unlatching position so as to extend upwardly over a portion of the lower U-shaped rack section within said unit to retain the same within the unit while the other section is being removed.

Detachably mounted along the inner sides of the end members 72 and 74 are open channel rack guides 94 and 96 that are so disposed during the loading mode of operation so as to guide one section of the rack (the upper or tine section) into engagement with another rack section. During the unloading mode of operation, the rack guides 94 and 96 can be detached from their inner position along a respective end member and mounted about the outside of the same end member.

Pivotably mounted above and generally rearwardly of the retaining frame 70 is a rack press assembly indicated generally by the numeral 98 and used exclusively in the loading mode of operation. The press assembly comprises a yoke structure 100 pivotably mounted about a transverse axis that extends generally parallel with either pivot axis assumed by the retaining frame 70. The yoke 100 includes a transverse cross bar **100*a* that includes a pair of laterally spaced swing arms 100*b* fixed thereto and extending therefrom. As will be described later herein in detail, rotors 102 and 104 fixed to the swing arms 100*b*** engage a certain portion of the rack as the yoke is pulled down by an operator, and the rollers under this pressure tend to force and press the particular rack section through the underlying bulk volume of tobacco.

In order to facilitate the understanding of the present invention and particularly the principal functions of the combination bulk rack loader and unloader, it will be beneficial to review the basic structure of the conventional single tier bulk tobacco rack. In this regard and with particular reference to FIGS. 2–9 of the drawings, it is seen that the rack, indicated generally by the numeral 108, comprises an open U-shaped rack section 110 that normally assumes a bottom position within the rack loader and unloader of the present invention. Disposed outwardly on each side of the U-shaped rack section is a latching channel 112 that is adapted to receive a notched latching member 118 that is carried about the outer end portions of a tine section 114. The tine section 114 is generally disposed within the rack loader and unloader of the present invention. It is thusly seen in the drawings that to latch the tine section 114 with the open U-shaped section 110, that the two are so aligned and so positioned that the latching member 118 which is normally biased outwardly, can be inserted through respective latching channels 112 and upon inserting the latching members 118 completely therethrough the latching members are biased outwardly to where a notch carried on the ends thereof is disposed in a latching relationship with the latching channels 112. And finally it is seen that the tine section 114 includes a plurality of projecting tines 116 that in operation project through the volume of bulk tobacco and serve to support portions thereof when the rack is disposed within a curing and drying structure.

THE LOADING OPERATION

The apparatus of the present invention is particularly adapted to work in conjunction with a conventional single tier bulk rack 108 and is designed to be used both in the loading and unloading operations of such a rack.

Figure 4:
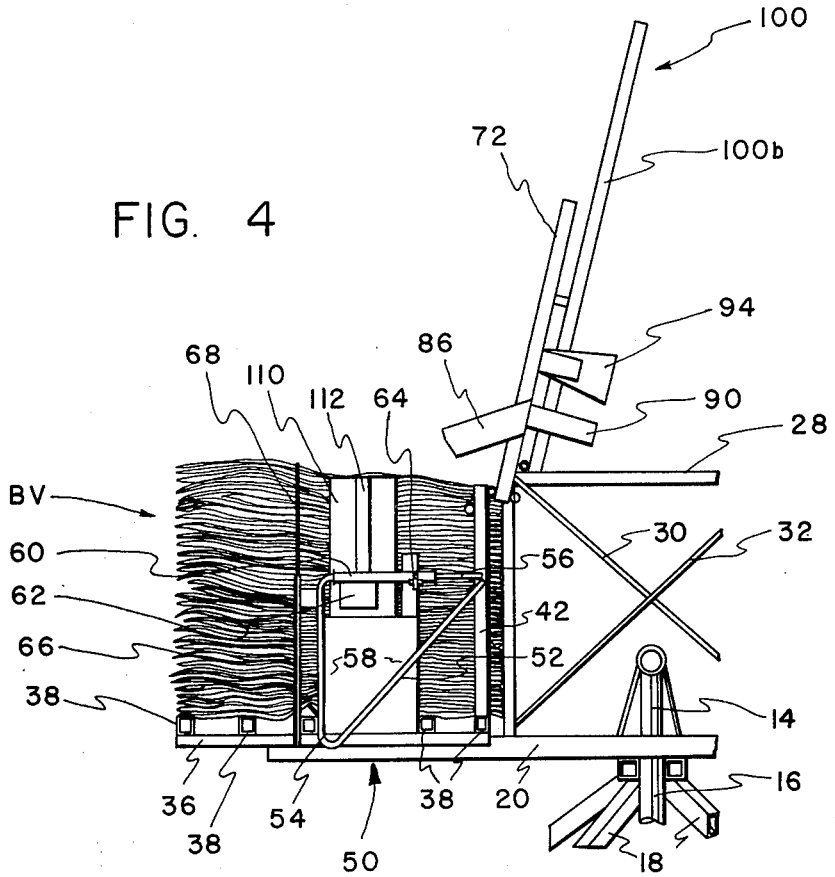
FIGS. 4 and 5 are fragmentary side elevational sequence views illustrating the loading mode of operation of the combination bulk tobacco rack loader and unloader of the present invention.
Figure 5:
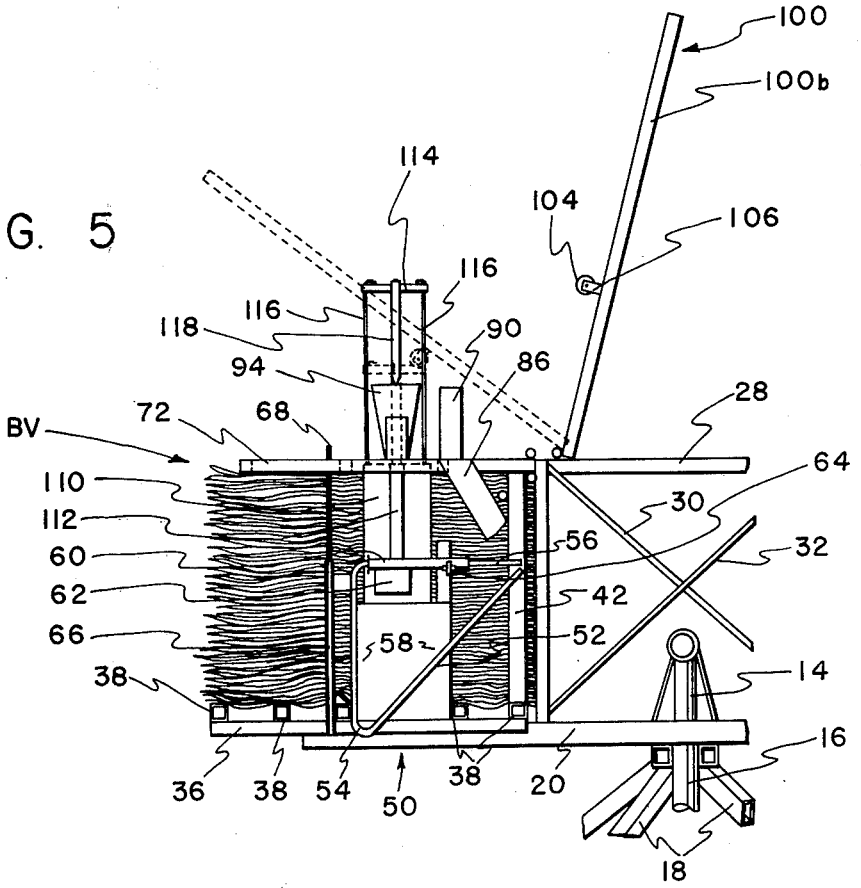

With reference to FIGS. 4 and 5 and the rack loading operation shown therein, the apparatus (a loader and unloader unit) is prepared for the loading operation by properly securing the guide channels 94 and 96 to the inner sides of the arms 72 and 74 of the retaining frame 70 generally between the cross members 78 and 80. The retaining frame 70 is pivotably mounted about one of the axis corresponding to either the upper or lower sleeves 46 and 48. Of prime importance is that the guides 94 and 96 align with the open U-shaped section 110 when the retaining frame 70 is pivoted downwardly to its generally horizontal or retaining position, as shown in FIG. 5.

After the guides 94 and 96 have been properly secured to the retaining frame 70 and the retaining frame has been properly secured about the axis that assures correct alignment with the U-shaped open rack section 110, then the apparatus of the present invention is ready to assist in the rack loading operation.

To begin the rack loading operation, the retaining frame 70 and the yoke press assembly 100 are both pivoted to their upward position, as shown in FIG. 4. Also, in the loading mode of operation, a retaining rod extension 68 is inserted into each of the base rod 66 disposed on each side of the apparatus, each base rod 66 and the extension therefor serving to generally confine the volume of tobacco within the apparatus and the open U-shaped rack section 110 during the loading operation.

Of course, in the loading operation, the U-shaped open rack section 110 is placed in an upright position as illustrated in FIGS. 4 and 5 and this portion of the rack is appropriately disposed transversely across the rack seat area 40 formed along the bottom portion of the apparatus. To actually load the rack, tobacco leaves are placed over the U-shaped rack section 110 and between the outer upstanding ends thereof. As viewed in FIG. 5, it is seen that as the tobacco leaves are placed over the rack section 110 such that portions of the volume of tobacco are actually supported by the bottom area of the apparatus, particularly cross members 38. Although the leaves in certain occasions may be placed in random alignment across the open U-shaped rack section, it is sometimes a customary practice to align the leaves within the rack section such that the mid-ribs of the leaves extend generally perpendicularly across the transverse width of the open U-shaped rack section 110. In any event, after a certain volume of tobacco leaves BV have been placed within the confines of the generally U-shaped rack section and the retaining rod extensions 66, it then becomes time to press the tine section 114 into a latched relationship with the lower disposed U-shaped rack section 110.

As seen in FIG. 5, the tine section 114 is placed above the volume BV of tobacco leaves in alignment with the open U-shaped section 110. After this, the tine section 114 is generally pressed downward such that the tines 116 carried thereby penetrate through a top portion of the bulk volume BV of tobacco leaves confined within the U-shaped rack section 110. After this initial hand or manual pressing, the tine section 114 becomes generally stable within the top portion of the bulk volume and further pressing by hand becomes difficult. At this point, which is illustrated in dotted lines of FIG. 5, the yoke press assembly 100 is pivoted counterclockwise, as viewed in FIG. 5, to where the rollers 102 and 104 associated therewith engage the top portion of the tine section 114. The operator then pulls downwardly on the cross member 100*a* causing a force to be exerted downwardly on the tine section 114 by the rollers 102 and 104, causing the tine section to be pressed further downwardly until a latching notch 118*a* on each of the latching members 118 extends through a respective latching channel 112 and is disposed in a latched relationship therewith. Once the tine section has been properly latched with the U-shaped section 110, the press assembly 100 and retaining frame 70 is pivoted clockwise, as viewed in FIGS. 4 and 5, to their upper position and the loaded bulk rack 108 can be removed therefrom by the use of a chain hoist or other suitable means and placed in a curing and drying structure.

THE UNLOADING OPERATION

Figure 6:
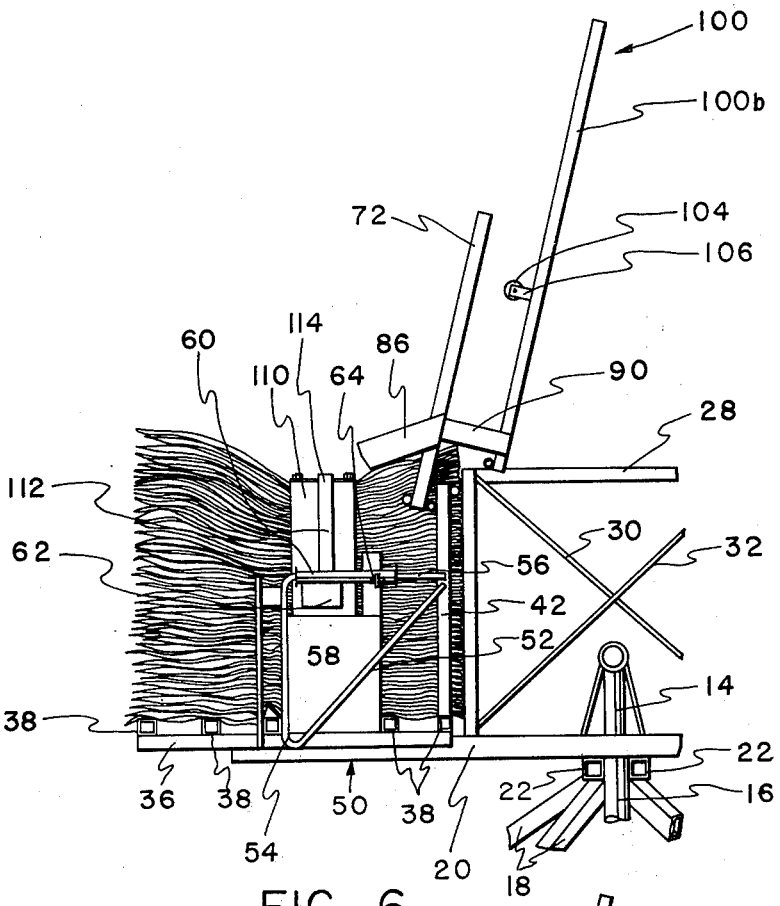
FIGS. 6–9 are fragmentary side elevational views of the rack loader and unloader apparatus illustrating the sequential operation thereof during the unloading operation.

With particular reference to FIGS. 6–9, the unloading operation is initiated by placing a loaded and coupled bulk rack 108 into the apparatus as viewed in FIG. 6 with both the retaining frame 70 and the press assembly 100 in their upward nonoperative positions. It should be pointed out that in the unloading mode of operation, that the guides 94 and 96 utilize to guide the tine section 114 during the loading operation are now removed, and as a matter of convenience, it is contemplated that the design of the apparatus would allow the guides 94 and 96 to be detachably mounted outwardly on the retaining frame 70. In the unloading mode of operation, the guides 94 and 96 would be attached to the outer side of the arms 72 and 74 in position that would not interfere in the unloading operation. Also, it should be pointed out that the pivot axis of the retaining frame 70 may be required to be changed from that assumed during the loading operation to assure that the cam arms 86 and 88 are properly positioned for alignment with the cam followers 64 disposed on the rock shaft 60.

Figure 7:
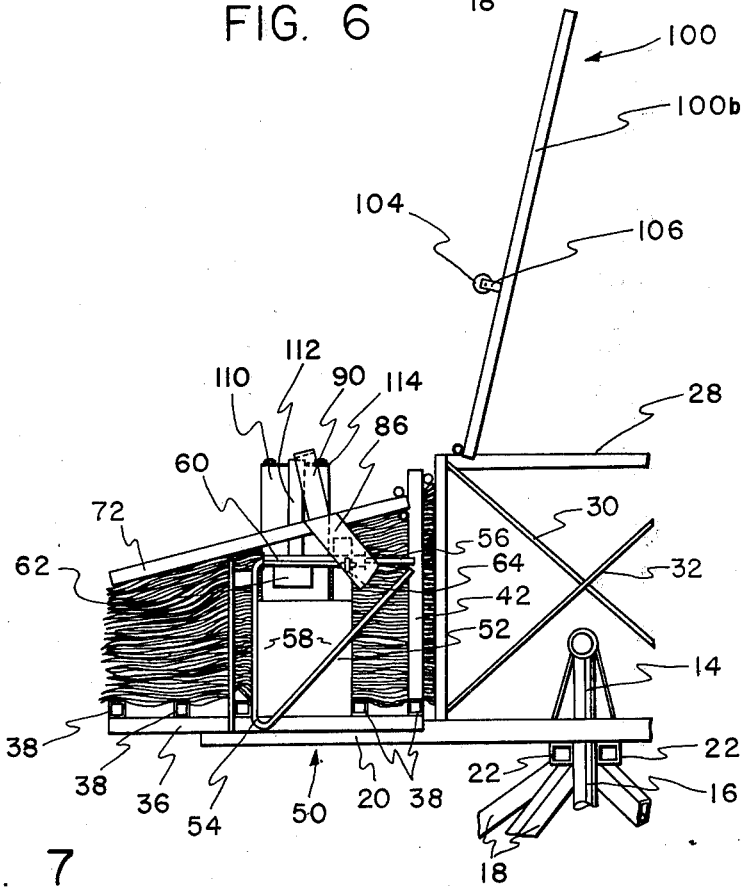

After these preliminary adjustments have been made, the unloading operation is started by the operator grasping the upper cross member 76 of the retaining frame 70 and pulling the same downwardly so as to rotate the retaining frame counterclockwise, as viewed in FIGS. 6 and 7, to an unlatching position corresponding to the position assumed in FIG. 7. As the retaining frame is pulled downwardly into the unlatching position, it is seen that the cam arms 86 and 88 engage the cam followers 64 of each unlatching mechanism associated with the rack loader and unloader apparatus. The engagement of the cam followers 64 causes each cam plate 62 to be rotated inwardly toward the rack. Because of the particular positioning of the unlatching mechanism with respect to the position of the rack 108 within the apparatus, the unlatching plates 62 engage the portion of the rack latching members 118 that extend through the lower opening within the latching channel 112 disposed on the outer sides of the open U-shaped rack section 110. As best illustrated in FIG. 3, each unlatching member 118 has a notch 118*a* formed on the end thereof and particularly spaced so as to normally assume an outer latch position with respect to the respective latching channel 112 since the latching member is normally biased outwardly. Consequently then, the engagement of the unlatching plate 62 with the latching member 118 results in the notch being depressed inwardly to an unlatched position and, therefore, the tine section 114 can be conveniently removed from the open U-shaped section 110 by an operator grasping the tine section 114 and pulling generally upwardly.

Figure 8:
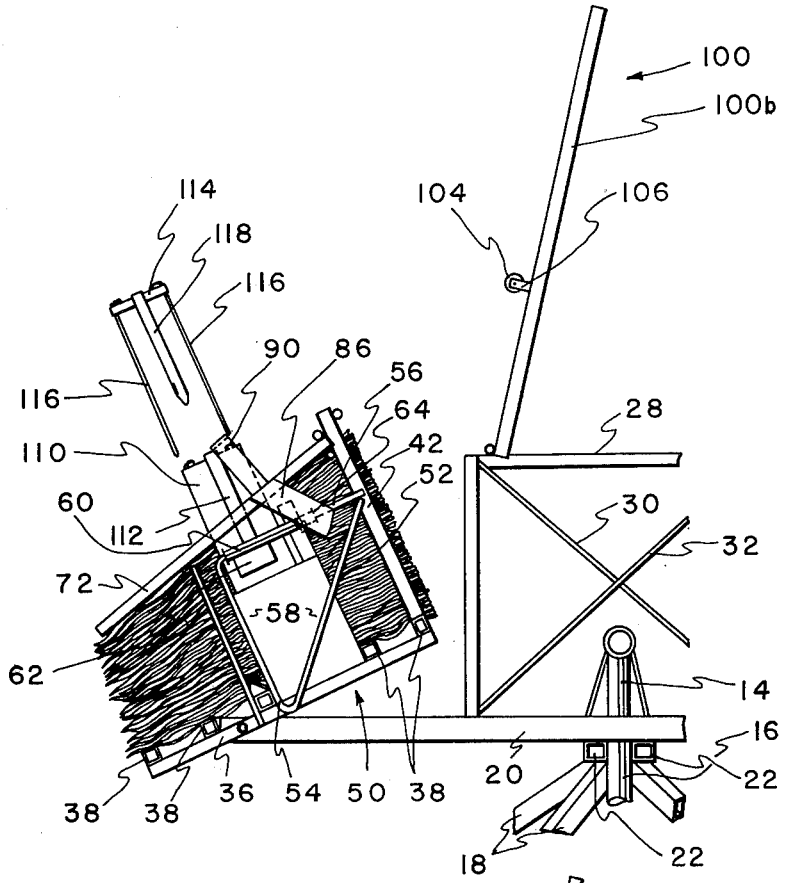
Figure 9:
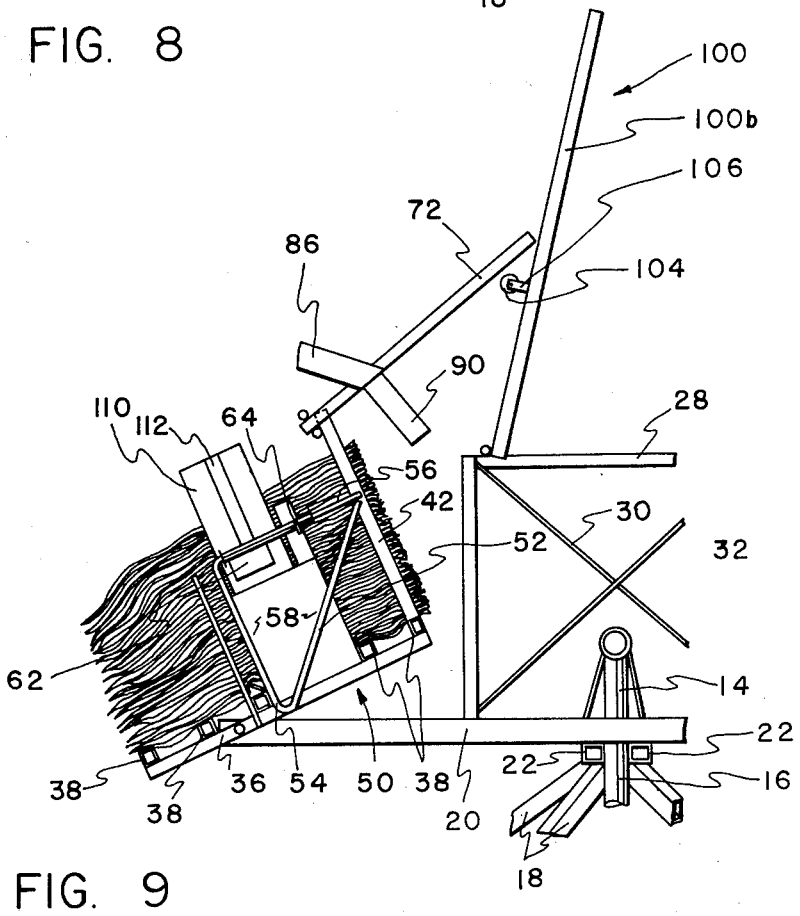

As seen in FIG. 8, the apparatus is pivotably mounted about a transverse axis to the horizontal members 20 of the turn table, such that the entire unloader apparatus may pivot a limited degree counterclockwise, as viewed in FIG. 8, towards the operator in order that a more convenient pulling direction can be achieved. Any form of a stop may be provided to limit the pivot movement of the apparatus during the unloading operation. One arrangement would provide for engagement of the loader apparatus with the horizontal members 20 after the apparatus has pivoted a predetermined amount.

It is important to realize that in pulling the tine section 114 from the apparatus during the unloading operation that the cured and dried tobacco leaves comprising the bulk volume tend to be retained by the tines 116 of the tine section 114. Therefore, to retain the tobacco leaves within the apparatus during the unloading operation, it is appreciated that the various cross members of the retaining frame 70, particularly cross members 76, 78 and 80 effectively cause the tobacco leaves to be stripped from the tines 116 as the rack section 114 is pulled from the apparatus.

After the tine section 114 has been removed, the retaining frame 70 is pivoted back to its upward nonoperative position and the cured and dried leaves disposed within the confines of the open U-shaped rack section 110 are removed therefrom and customarily placed in sheets or the like and either stored or transported to market. Of course, it follows that once the cured and dried tobacco has been removed, the open U-shaped rack section 110 can be removed from the apparatus and another loaded rack can be placed therein for unloading.

From the above, it follows that the present invention presents a new and very advantageous design for a bulk tobacco rack loader and unloader. The use of such an apparatus will in ordinary situations and circumstances eliminate at least some of the labor required in harvesting tobacco and particularly in loading and unloading bulk tobacco racks, and such is quite important today in view of the scarcity of farm labor.

The terms "upper", "lower", "forward", "rearward", etc., have been used herein merely for the convenience of the foregoing specification and in the appended claims to describe the combination bulk tobacco rack loader and unloader and method of unloading a bulk tobacco rack and its parts as oriented in the drawings. It is to be understood, however, that these terms are in no way limiting to the invention since the combination bulk tobacco rack loader and unloader and method of unloading a bulk tobacco rack may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A bulk tobacco rack unloader for receiving a filled tobacco rack and assisting in the removal of tobacco therefrom, wherein the bulk tobacco rack is of the type having first and second sections latched together by a latching mechanism and with tines extending from at least one section and penetrating through the bulk volume of tobacco peripherally contained by the bulk tobacco rack, said bulk tobacco rack unloader comprising:

a. frame structure means for receiving and supporting said bulk tobacco rack;

b. rack unlatching means disposed about said frame structure for engaging the latching mechanism of said bulk tobacco rack and unlatching said latching mechanism;

c. actuating means operatively connected to said unlatching means for selectively actuating said unlatching mechanism and causing said unlatching means to operatively engage said latching mechanism of said bulk tobacco rack and to unlatch the same whereby one section of said rack may be removed from the other section thereof; and d. said actuating means having retaining means operatively associated therewith and operatively responsive to the operation of said actuating means, said retaining means moveably mounted on said frame structure for movement between an inoperative position and an operative retaining position where said retaining means engages and lies across the entire bulk volume of tobacco within said rack for effectively stripping the bulk volume of tobacco from said tines of said one rack section as said one rack section is removed from said rack unloader.

2. The bulk tobacco rack unloader of claim 1 wherein said rack unlatching means includes an unlatching member means movably mounted adjacent the position normally occupied by the latching mechanism of the rack when disposed within said rack unloader, said unlatching member means movable between a first nonengaged position and a second engaged position with the latching mechanism of said rack wherein in said second engaged position with said latching mechanism the unlatching member means is operative to unlatch said latching mechanism of the rack whereby one section of the rack may be removed from the other.

3. The tobacco rack unloader of claim 2 wherein said actuating means includes a cam follower operatively connected to said movable member means of said unlatching mechanism, and cam means for engaging said cam follower and moving said movable member means between said first and second positions.

4. The bulk tobacco rack unloader of claim 3 wherein said movable member means is fixed to a rockshaft journal for rotation about the frame structure of said rack unloader and spaced outwardly from the position normally occupied by the rack latching mechanism when a tobacco rack is supported within said rack unloader, and wherein said cam follower is fixed to said rock shaft and extends therefrom so as to normally occupy a position that lies in the path of said cam means.

5. The rack unloader of claim 4 wherein said actuating means includes means pivotably mounted about a transverse axis to said rack unloader and having said cam means fixed thereto, whereby as said means pivotably mounted about said transverse axis is swung about the transverse axis the cam means carried thereby may engage the cam follower and thereby actuate said unlatching mechanism of the rack unloader.

6. The bulk tobacco rack unloader of claim 5 wherein said means pivotably mounted about a transverse axis to said unloader and forming a part of said actuating means includes a pair of laterally spaced arms pivotably mounted about said transverse axis and wherein each arm has said cam means fixed thereto for engaging a respective cam follower lying in its path; and wherein there is provided at least one transverse member extending between said arms and particularly operative when said unlatching means engages the latching mechanism of said rack to lie adjacent a top portion of the bulk volume of tobacco and to retain the same within the rack unloader as a respective section of the rack is pulled from the unloader.

7. The bulk tobacco rack of claim 1 further including a rack loading press assembly adapted to be mounted on said rack unloader and operative to press one section of the rack into operative latch relationship with another section of the rack during a loading operation, said press assembly including a pivotably mounted press arm structure for engaging one section of a bulk tobacco rack and under the influence of an external force pressing that section through a bulk volume of tobacco into a latched position with said other section of said bulk tobacco rack.

8. The device of claim 7 including guide means disposed about the frame structure thereof for guiding said one section of the rack into engagement with the other section as the press arm structure presses said one section downwardly through the bulk volume of tobacco.

9. A bulk tobacco rack unloader for receiving a filled tobacco rack and assisting in the removal of tobacco therefrom, wherein the bulk tobacco rack is of the type having first and second sections latched together by at least one latching mechanism of the type having a latching member movable from an inwardly unlatched position to an outward latched position, and at least one of said rack sections having tines extending therefrom and penetrating through the bulk volume of tobacco peripherally contained by the bulk tobacco rack, said bulk tobacco rack unloader comprising:

a. frame structure means for receiving and supporting said bulk tobacco rack;

b. rack unlatching means disposed about said frame structure for unlatching said rack latching mechanism and including engaging means mounted adjacent each respective unlatching mechanism for movement between a nonengaged position and an engaged position with the latching member thereof such that in the engaged position said engaging means is operative to move said latching member of the respective latching mechanism to its inward unlatched position to effectuate unlatching;

c. actuating means operatively connected to said unlatching means for moving said engaging means thereof from said nonengaged position to said engaged position to effectuate unlatching such that one section of said rack may be removed from the other section thereof; and d. retaining means for engaging and retaining the bulk volume of tobacco generally within said unloader as one section of said rack is removed therefrom after the rack unlatching mechanism has been unlatched, the rack section normally removed being the section having the tines extending therefrom and, therefore, in such case said retaining means is effective to strip the tobacco from the tines of the rack section as that section is removed from the unloader.

10. The bulk tobacco rack unloader of claim 9 wherein said retainer means comprises a retainer frame movably mounted to said frame structure and when operatively positioned extends transversely across and is engaged with a top portion of the bulk volume of tobacco disposed within said bulk tobacco rack unloader, thereby tending to prohibit the tobacco therein from moving above the level of said retaining frame as one of the rack sections is removed from the unloader.

11. The bulk tobacco rack unloader of claim 10 wherein said engaging means of said unlatching means is fixed to a rockshaft having a cam follower fixed thereto and extending therefrom; and wherein said actuating means includes a cam surface fixed to said retaining frame and operative to engage said cam follower and to rotate said rockshaft as said retaining frame is swung into operative position, the engagement of said cam follower by said cam surface resulting in said engaging means moving said latching member of the respective rack unlatching mechanism to its inwardly unlatched position.

12. The bulk tobacco rack unloader of claim 9 wherein said bulk tobacco rack is of the type having a latching mechanism on opposite ends thereof, and wherein the unlatching means of said unloader includes two like unlatching means, each disposed about opposite sides of the unloader and adapted to assume a position outwardly of a respective latching mechanism of the rack when the rack is placed within the loader; and wherein said actuating means includes means for simultaneously actuating each of said unlatching means which in turn results in the simultaneous unlatching of both latching mechanisms of the rack.

13. The bulk tobacco rack unloader of claim 12 wherein the engaging means of each of the unlatching means is in the form of a plate and is fixed to a rockshaft that extends generally parallel to the plane of the rack end and is journaled for rotation, the rockshaft having a cam follower fixed thereto and extending therefrom; and wherein there is provided a pair of swing arms pivotably mounted about a transverse axis to said frame structure and including said retaining means fixed thereto and extending therebetween, said swing arms including a pair of laterally spaced cam surfaces particularly spaced to engage a respective cam follower in response to the swing arms being swung from an upper position to a lower position where the retaining means lies adjacent the top portion of the bulk volume of tobacco disposed within said unloader.

14. The bulk tobacco rack unloader of claim 13 including stop means for generally prohibiting one rack section from being removed from the unloader as the other rack section is pulled therefrom.

15. The tobacco rack unloader of claim 9 including a lower support structure for receiving and supporting the tobacco rack unloader, and wherein said tobacco rack unloader is pivotably mounted to said lower support structure so as to allow the tobacco rack unloader to pivot and tilt towards the individual pulling the rack from the unloader, thereby tending to allow the one pulling the rack section to pull towards himself and consequently, exert a greater pulling force on the rack section to be removed.

16. A combination bulk tobacco rack unloader and loader for loading and unloading a bulk tobacco rack of the type having first and second sections latched together by at least one latching mechanism and at least one of said rack sections having tines extending therefrom and penetrating through the bulk volume of tobacco peripherally contained by the bulk tobacco rack, said combination bulk tobacco rack loader and unloader comprising:

a. frame structure means for receiving and supporting said bulk tobacco rack;

b. rack unlatching means disposed about said frame structure for unlatching said rack latching mechanism and including engaging means mounted adjacent each respective unlatching mechanism for movement between a nonengaged position and an engaged position with the latching member thereof such that in the engaged position said engaging means is operative to move said latching member of the respective latching mechanism to its inward unlatched position to effectuate unlatching;

c. actuating means operatively connected to said unlatching means for moving said engaging means thereof from said nonengaged position to said engaged position to effectuate unlatching such that one section of said rack may be removed from the other section thereof;

d. retaining means for engaging and retaining the bulk volume of tobacco generally within said unloader as one section of said rack is removed therefrom after the rack unlatching mechanism has been unlatched, the rack section normally removed being the section having the tines extending therefrom and, therefore, in such case said retaining means is effective to strip the tobacco from the tines of the rack section as that section is removed from the unloader; and e. a press assembly adapted to be movably mounted to said frame structure and utilized during the rack loading operation to press one rack section into a latched relationship with said other section, said press assembly including hand actuated press means for engaging said one rack section and pressing the same into a latched relationship with said other section.

17. The combination bulk tobacco rack loader and unloader of claim 16 further including guide means fixed to the frame structure thereof for guiding the one rack section being pressed into proper alignment with the other rack section such that a latched relationship can be achieved.

18. The combination bulk tobacco rack loader and unloader of claim 17 further including a pair of generally upstanding leaf retainer members for confining the tobacco within the combination loader and unloader during a loading operation; and wherein said press assembly includes a generally U-shaped yoke member pivotably mounted about a transverse axis with respect to said frame structure and including roller means rotatively mounted to a transverse portion thereof for engaging the one rack section being pressed into latched relationship with the other rack section, said roller means engaging the rack as the U-shaped yoke member is pulled down by hand.

19. A method of unloading a loaded bulk tobacco rack of the type containing a bulk volume of tobacco therein and generally comprising first and second separable rack sections latched together when loaded by at least one latching mechanism, and including tines fixed to one of said sections and extending therefrom so as to penetrate through the volume of bulk tobacco held within said bulk tobacco rack, said method comprising the steps of:

a. supporting said loaded bulk tobacco rack;

b. unlatching said latching mechanism holding said rack sections together;

c. pulling and completely separating said rack section with the tines extending therefrom from said other section; and d. engaging a top portion of said bulk volume of tobacco held by said bulk tobacco rack and retaining and holding said volume of bulk tobacco generally stationary about said other rack section as said rack section with the tines extending therefrom is pulled and separated from said other rack sections.

20. The method of unloading a bulk tobacco rack, as recited in claim 19, wherein the step of supporting said bulk tobacco rack particularly comprises the step of supporting the bulk tobacco rack such that the rack section with the tines associated therewith is disposed above the other rack section, with said other rack section being directly supported such that the plane of the tobacco leaves of the bulk volume extend in generally parallel horizontal planes.

21. The method of unloading a bulk tobacco rack, as recited in claim 20, wherein the bulk tobacco rack includes a pair of latching mechanisms and wherein the step of unlatching the latching mechanism of the bulk tobacco rack particularly includes the step of simultaneously unlatching both latching mechanisms of said bulk tobacco rack.

22. The method of unloading a bulk tobacco rack, as recited in claim 21, wherein the step of retaining generally the entire bulk volume of tobacco includes engaging a top portion of the bulk tobacco volume across the entire transverse width thereof and holding the bulk volume of tobacco generally stationary such that the tobacco is stripped from the tines of the rack section being pulled therefrom.

* * * * *